US005305728A

United States Patent [19]

Young et al.

[11] Patent Number: 5,305,728

[45] Date of Patent: Apr. 26, 1994

[54] BOW SIGHT APPARATUS

[76] Inventors: Dennis L. Young, R.D. #1, Box 28A, Lot #19, Enon Valley, Pa. 16120; Robert E. Davenport, R.D. #2, Box 2307, Wampum, Pa. 16157

[21] Appl. No.: 999,264

[22] Filed: Dec. 31, 1992

[51] Int. Cl.[5] ..... F41G 1/467

[52] U.S. Cl. ..... 124/87; 33/265

[58] Field of Search ..... 124/23.1, 24.1, 25.6, 124/86, 87, 88; 33/265

[56] References Cited

U.S. PATENT DOCUMENTS

| | | | |
|---|---|---|---|
| 4,215,485 | 8/1980 | Mesler | 33/265 |
| 4,620,372 | 11/1986 | Goodrich | 33/265 |
| 4,669,194 | 6/1987 | Amacker | 33/265 |
| 4,915,088 | 4/1990 | Powers | 124/87 |
| 4,977,678 | 12/1990 | Sears | 33/265 |
| 5,048,193 | 9/1991 | Hacquet | 33/265 |

*Primary Examiner*—Randolph A. Reese
*Assistant Examiner*—John Ricci
*Attorney, Agent, or Firm*—Leon Gilden

[57] ABSTRACT

A bow sight member includes a mounting plate secured to a bow in an orthogonal relationship, with the mounting plate including an L-shaped front sight support member projecting forwardly of the bow, with an L-shaped rear sight member positioned rearwardly of the bow, wherein each sight member includes a mounting plate arranged in a coplanar relationship to slidably secure respective front and rear sight plates thereon, with the front and rear sight plates respectively mounting respective front and rear sights.

3 Claims, 4 Drawing Sheets

FIG 6
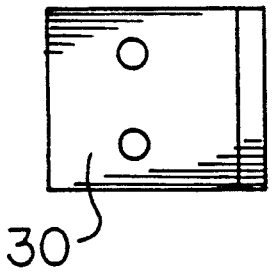
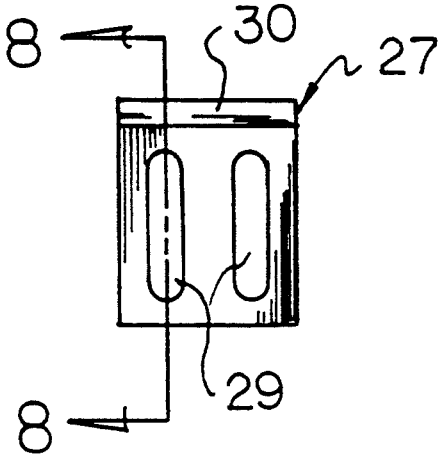
FIG 7
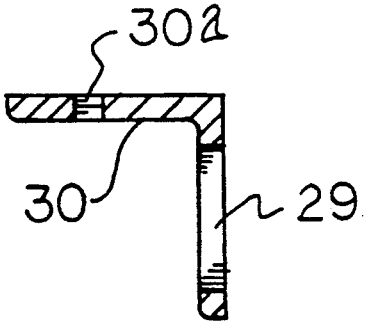
FIG 8
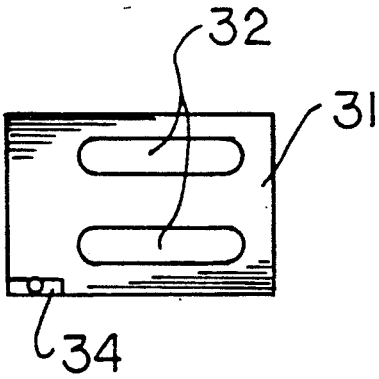
FIG 9
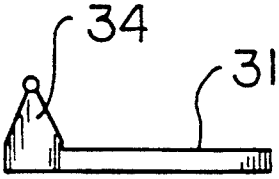
FIG 10

BOW SIGHT APPARATUS

BACKGROUND OF THE INVENTION

1. Field of the Invention

The field of invention relates to bow sight apparatus, and more particularly pertains to a new and improved bow sight apparatus wherein the same is directed to the securement of a bow sight structure relative to an associated archery bow.

2. Description of the Prior Art

The use of sight structure mounted relative to an associated archery bow is present in the prior art in a variety of configurations, such as indicated in the U.S. Pat. Nos. 5,050,576; 4,967,478; 4,894,921; and 4,999,919.

The instant invention attempts to overcome deficiencies of the prior art by providing for a bow sight structure arranged for ease of adjustment and accommodation of an archery quiver utilizing a compact rigid organization and in this respect, the present invention substantially fulfills this need.

SUMMARY OF THE INVENTION

In view of the foregoing disadvantages inherent in the known types of bow sight apparatus now present in the prior art, the present invention provides a bow sight apparatus wherein the same provides for a unitary mounting plate secured orthogonally relative to an archery bow adjacent its handle for mounting forward and rear sights forwardly and rearwardly of the associated archery bow. As such, the general purpose of the present invention, which will be described subsequently in greater detail, is to provide a new and improved bow sight apparatus which has all the advantages of the prior art bow sight apparatus and none of the disadvantages.

To attain this, the present invention provides a bow sight member including a mounting plate secured to a bow in an orthogonal relationship, with the mounting plate including an L-shaped front sight support member projecting forwardly of the bow, with an L-shaped rear sight member positioned rearwardly of the bow, wherein each sight member includes a mounting plate arranged in a coplanar relationship to slidably secure respective front and rear sight plates thereon, with the front and rear sight plates respectively mounting respective front and rear sights.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bow sight apparatus which has all the advantages of the prior art bow sight apparatus and none of the disadvantages.

It is another object of the present invention to provide a new and improved bow sight apparatus which may be easily and efficiently manufactured and marketed.

It is a further object of the present invention to provide a new and improved bow sight apparatus which is of a durable and reliable construction.

An even further object of the present invention is to provide a new and improved bow sight apparatus which is susceptible of a low cost of manufacture with regard to both materials and labor, and which accordingly is then susceptible of low prices of sale to the consuming public, thereby making such bow sight apparatus economically available to the buying public.

Still yet another object of the present invention is to provide a new and improved bow sight apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic bottom view of the sight support member utilized by the invention.

FIG. 7 is an orthographic end view of the sight support member.

FIG. 8 is an orthographic view, taken along the lines 8—8 of FIG. 7 in the direction indicated by the arrows.

FIG. 9 is an orthographic top view of the front sight plate structure.

FIG. 10 is an orthographic side view of the front sight plate structure.

DESCRIPTION OF THE PREFERRED EMBODIMENT

Figure 2:
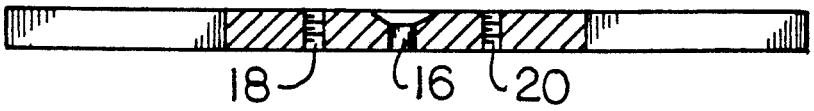
FIG. 2 is an orthographic view, taken along the lines 2—2 of FIG. 1 in the direction indicated by the arrows.
Figure 1:
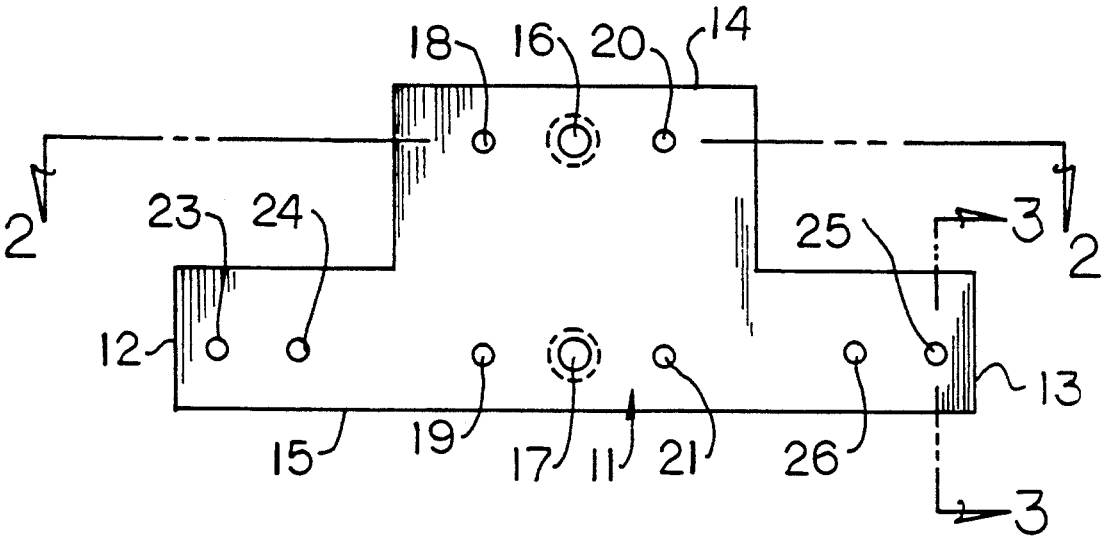
FIG. 1 is an orthographic view of the mounting plate structure of the invention.
Figure 3:
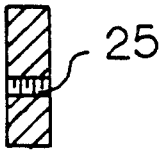
FIG. 3 is an orthographic view, taken along the lines 3—3 of FIG. 1 in the direction indicated by the arrows.
Figure 4:
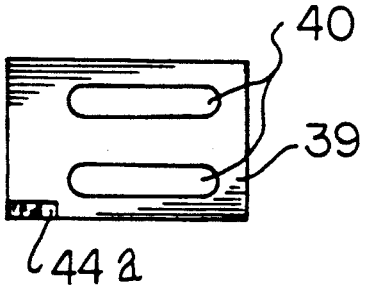
FIG. 4 is an orthographic top view of the rear sight plate structure of the invention.
Figure 5:
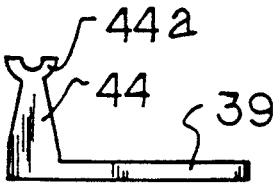
FIG. 5 is an orthographic side view of the rear sight plate structure of the invention.

With reference now to the drawings, and in particular to FIGS. 1 to 14 thereof, a new and improved bow sight apparatus embodying the principles and concepts of the present invention and generally designated by the reference numeral 10 will be described.

Figure 11:
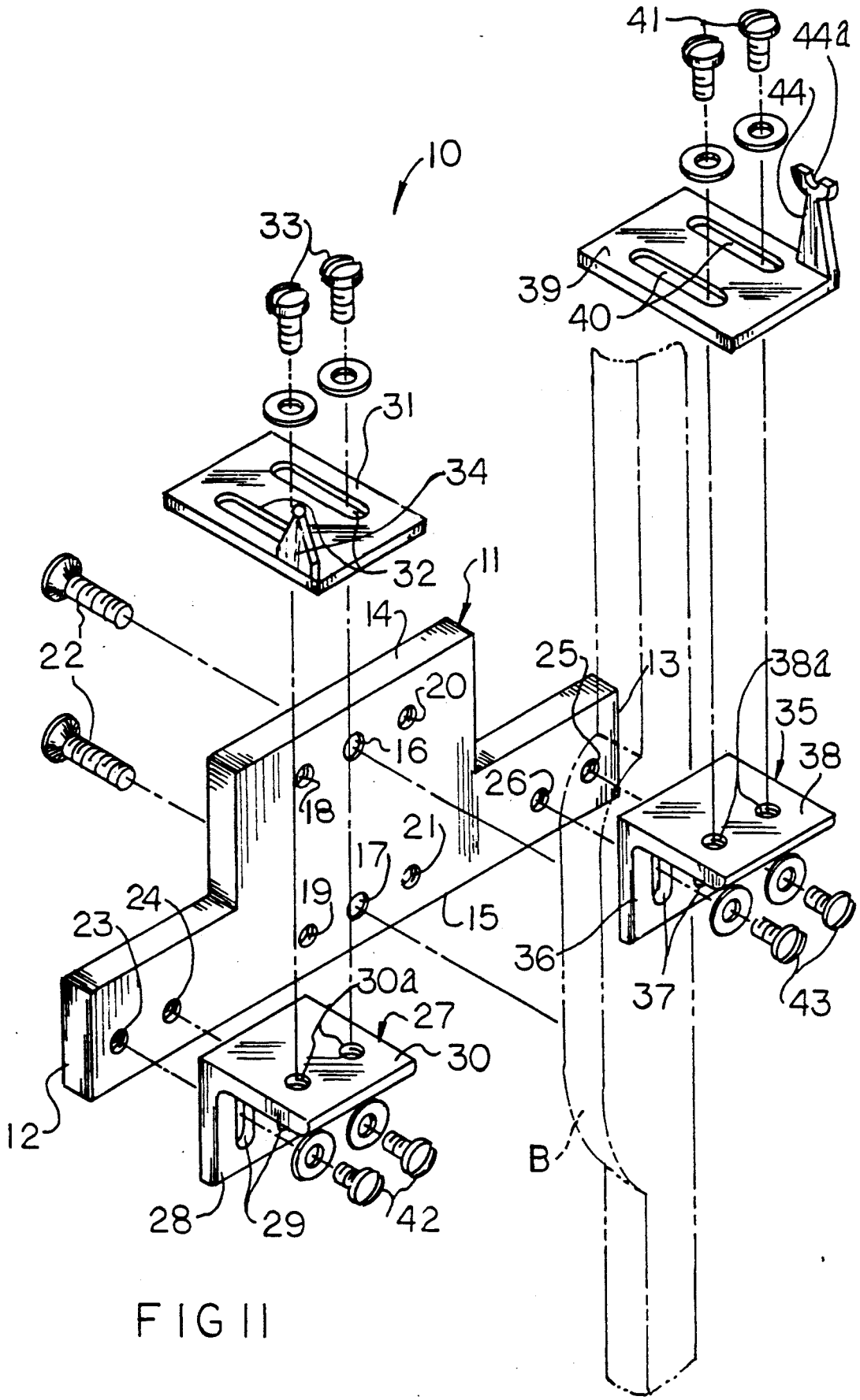
FIG. 11 is an isometric illustration of the invention relative to an associated archery bow illustrated in isometric and exploded view.

More specifically, the bow sight apparatus 10 of the instant invention essentially comprises a mounting plate 11 having planar side walls, including a first end 12 spaced from a second end 13, with a top side 14 spaced from a bottom side 15. First and second smooth mounting bores 16 and 17 defining a first row are directed through the mounting plate medially of the first and second ends 12 and 13. Third and fourth internally threaded mounting bores 18 and 19 defining a second row of bores are positioned between the first row and the first end 12. Fifth and sixth internally threaded mounting bores 20 and 21 defining a third row of bores are directed through the mounting plate between the first row and the second end, wherein the first, second and third row of mounting bores are arranged in a parallel relationship relative to one another. The first row of mounting bores are arranged to receive fasteners 22 to secure the mounting plate 11 relative to a bow "B", as illustrated in FIG. 11. The second row of mounting bores are internally threaded and arranged to receive fastening of a quiver for use by a left-handed shooter, wherein the third row of mounting bores 20 and 21 are arranged to receive an arrow quiver for a right-handed shooter relative to the bow "B". The arrow quiver structure is not shown but is of conventional construction, wherein the second and third rows of bores are available for mounting of such structure. A fourth row of bores of a seventh and eighth internally threaded bore 23 and 24 are positioned adjacent the first end 12 and are orthogonally oriented relative to the first, second, and third row of bores. Ninth and tenth internally threaded bores 25 and 26 adjacent the second end 13 are colinear with the fourth row, as illustrated.

Figure 14:
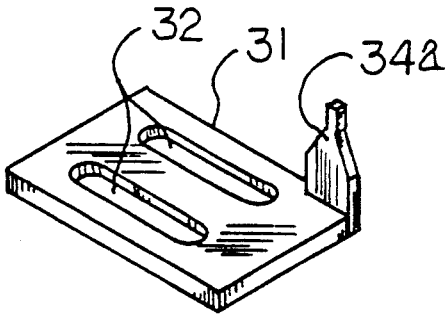
FIG. 14 is an isometric illustration of a modified front sight member post structure.

An L-shaped front sight support member 27 is provided, having a first plate 28 orthogonally mounted to a second plate 30. The first plate 28 includes a plurality of parallel slots directed therethrough, with the slots 29 arranged for alignment with one of the seventh and eighth bores 23 and 24. A plurality of second plate threaded bores 30*a* are directed through the second plate to receive a front sight plate 31 thereon, wherein the front sight plate includes a plurality of parallel front sight plate slots 32 orthogonally oriented relative to the first plate 28, and to include front sight fasteners 33 directed through the front sight plate slot 32 into the second plate threaded bores 30*a*. A front sight post 34 is mounted orthogonally to the front sight plate 31 for alignment with a rear sight, to be discussed in more detail below. An alternative front sight, as indicated in FIG. 14, has a modified post 34*a*.

An L-shaped rear sight support member 35 is provided of substantially identical construction to the front sight support member 27. A third plate 36 is orthogonally mounted integrally to a fourth plate 38, wherein the third plate 36 includes a plurality of parallel third plate slots 37, with the third plate slots 37 arranged to receive one of the ninth and tenth internally threaded bores 25 and 26 respectively to include rear fasteners 43 through the slots 37 into the bores 25 and 26. Similarly, front fasteners 42 are directed through the slots 29 into the associated bores 23 and 24. The fourth plate 38 includes a plurality of fourth plate bores 38*a*, with a rear sight plate 39 provided, having rear sight plate slots 40 in a parallel relationship relative to one another and orthogonally oriented relative to the third plate 36, as well as to the mounting plate 11. Rear sight plate fasteners 41 directed through the slots 40 are received within the bores 38*a*. In this manner, the front and rear sight plates are arranged for adjusting orientation orthogonally relative to the mounting plate 11.

Figure 12:
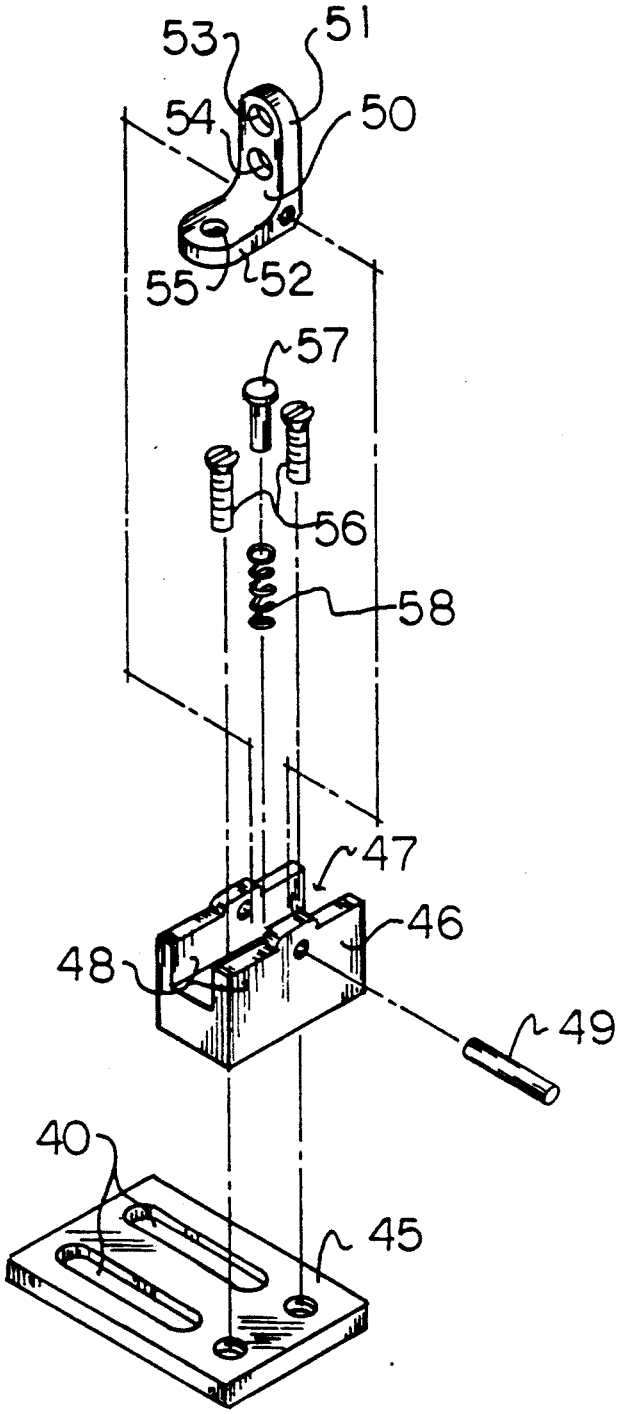
FIG. 12 is an orthographic exploded view a modified rear sight member utilized by the invention.
Figure 13:
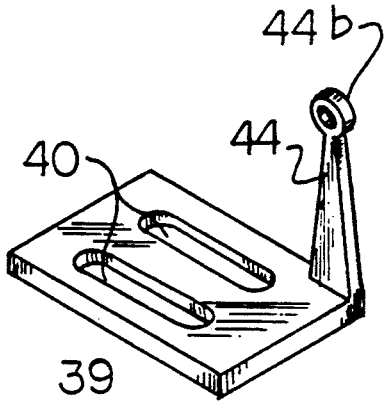
FIG. 13 is an isometric illustration of a modified rear sight member post structure.

The FIG. 12 indicates the use of a modified rear sight plate 45 having in addition to the parallel rear sight plate slots 40, a plurality of rear sight plate threaded bores 45*a*. A sighting block is provided, having sight block fasteners 56 directed therethrough received within the rear sight plate threaded bores 45*a*, as illustrated. The sighting block 46 includes a groove 47 oriented between parallel flanges 48 projecting from a top wall of the sighting block 46. The flanges 48 are orthogonally oriented relative to the rear sight plate 45. Further, an axle 49 is directed through the flanges 48, with the axle further directed through an L-shaped sight member 50, with the L-shaped sight member 50 receiving the axle 49 therethrough at an intersection of a first and second sight blade 51 and 52 of the L-shaped sight 50. The first sight blade 51 includes first sight blade first and second bores 53 and 54 oriented parallel relative to one another through the first sight blade, with the second sight blade including a second sight blade first bore 55. The first sight blade bores 53 and 54 are orthogonally oriented relative to the second sight plate first bore 55. In this manner, a plunger 57 positioned below the L-shaped sight 50 arranged to intersect the L-shaped sight 50 in adjacency to the axle and below the axle 49 imposes upon the L-shaped sight 50 at the intersection of the first and second sight blades 51 and 52 to maintain the L-shaped sight in an orientation to position selectively the first or second sight blade 51 and 52 orthogonally relative to the top wall of the sighting block 46 within the groove 47. The modified rear sight structure, as indicated in FIG. 12, is utilized to provide for variously diameter peep sights as the bores 53, 54, and 55 are of varying diameters to provide for varying fields of view in a peep sight usage.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A bow sight apparatus arranged for securement to an archery bow, wherein the apparatus comprises, a mounting plate, the mounting plate having a planar first side parallel to a planar second side, and the mounting plate having a first end spaced from a second end, and a top side spaced from a bottom side, wherein the mounting plate includes a first smooth mounting bore and a second smooth mounting bore directed through the mounting plate an equal distance between the first end and the second end defining a first row, and an internally threaded third mounting bore and an internally threaded fourth mounting bore spaced an equal distance relative to the first end between the first end and the first row, wherein the third mounting bore and the fourth mounting bore define a second row, and a fifth internally threaded mounting bore and a sixth internally threaded mounting bore directed through the mounting plate between the first row and the second end, wherein the fifth mounting bore and the sixth mounting bore are spaced an equal distance relative to the second end, and define a third row, wherein the first row, the second row, and the third row are parallel relative to one another, and the first mounting bore and the second mounting bore each receiving a fastener therethrough for securement of the mounting plate to the bow, and the third mounting bore and the fourth mounting bore are arranged for reception of an arrow quiver for use by a left-handed shooter, and the fifth and the sixth mounting bore are arranged for reception of a bow quiver relative to a right-handed shooter upon securement of the mounting plate to the bow, and a seventh internally threaded bore and an eighth internally threaded bore defining a fourth row, wherein the seventh bore and the eighth bore are positioned in adjacency relative to the first end between the second row and the first end, and orthogonally oriented relative to the second row, and a ninth internally threaded bore and a tenth internally threaded bore defining a fifth row positioned adjacent the second end between the third row and the second end, wherein the fourth row and the fifth row are colinear relative to one another and orthogonally oriented relative to each of the first row, the second row, and the third row, and a front sight means mounted to the fourth row, and a rear sight means arranged for mounting to the fifth row, and the front sight means includes an L-shaped front sight support member having a first plate orthogonally and integrally mounted to a second plate, the first plate having first plate parallel slots, and the first plate in contiguous communication with the mounting plate, and front sight fasteners directed through the first plate slots, with one of said front plate fasteners received within one of said seventh bore and eighth bore, and a front sight plate having a plurality of front sight plate slots orthogonally oriented relative to the first plate, and front sight fasteners directed through the front sight plate slots, and the second plate having second plate threaded bores, and the front sight fasteners received within the second plate threaded bores, and a front sight post orthogonally and fixedly mounted to the front sight plate.

2. An apparatus as set forth in claim 1 wherein the rear sight plate includes an L-shaped rear sight support member having a third plate orthogonally mounted to a fourth plate, the third plate having third plate slots, and third plate fasteners directed through the third plate slots, and one of said third plate fasteners received within a bore of said ninth bore and said tenth bore, and the fourth plate having fourth plate internally threaded bores, and a rear sight plate, the rear sight plate having parallel rear sight plate slots orthogonally oriented relative to the third plate, and rear sight plate fasteners, wherein one of said rear sight plate fasteners is directed through one of said rear sight plate slots and received within one of said fourth plate bores, and a rear sight member mounted upon the rear sight plate for alignment with the front sight post.

3. An apparatus as set forth in claim 2 wherein the rear sight member includes a sighting block, the sighting block fixedly mounted to the rear sight plate and having a groove, the groove oriented parallel relative to the mounting plate, and the sighting block having a sighting block top wall and parallel flanges having a groove directed therebetween projecting upwardly relative to the sighting block top wall, and an axle directed through the sighting block flanges in an orthogonal orientation, and an L-shaped sight having a first sight blade and a second sight blade joined at an intersection, with the axle pivotally directed through the intersection, the first sight blade having at least one first sight blade bore and the second sight blade having at least one second sight blade bore, and a plunger directed into the sighting block top wall oriented between the sighting block top wall and directed in contiguous communication with the intersection, and a plunger spring mounted between the plunger and the sighting block top wall to bias the plunger into engagement with the intersection.

* * * * *